US005267005A

United States Patent [19]

Yamamoto et al.

[11] Patent Number: 5,267,005

[45] Date of Patent: Nov. 30, 1993

[54] HEATER HAVING STEPPED PORTION AND HEATING APPARATUS USING SAME

[75] Inventors: Akira Yamamoto; Jun Asai, both of Tokyo; Atsushi Hosoi; Kensaku Kusaka, both of Kawasaki; Yoshiaki Kobayashi, Tokyo; Hidekazu Maruta, Hachiohji; Shigeo Kimura, Yokohama, all of Japan

[73] Assignee: Canon Kabushiki Kaisha, Tokyo, Japan

[21] Appl. No.: 815,146

[22] Filed: Dec. 31, 1991

[30] Foreign Application Priority Data

Jan. 8, 1991 [JP] Japan ..... 3-000559

[51] Int. Cl.[5] ..... G03G 15/20

[52] U.S. Cl. ..... 355/290; 338/306; 346/76 PH

[58] Field of Search ..... 219/216, 243; 338/306, 338/307, 308, 309; 346/76 PH; 355/285, 289, 290

[56] References Cited

U.S. PATENT DOCUMENTS

| | | | |
|---|---|---|---|
| 4,203,025 | 5/1980 | Nakatani et al. | 219/216 |
| 4,719,489 | 1/1988 | Ohkubo et al. | 355/290 |
| 4,777,583 | 10/1988 | Minami et al. | 346/76 PH |
| 4,954,845 | 9/1990 | Yano et al. | 355/290 |
| 5,026,276 | 6/1991 | Hirabayashi et al. | 432/59 |
| 5,027,160 | 6/1991 | Okada et al. | 355/282 |
| 5,043,763 | 8/1991 | Koh et al. | 355/206 |
| 5,051,784 | 9/1991 | Yamamoto et al. | 355/285 |
| 5,083,168 | 1/1992 | Kusaka et al. | 355/285 |

FOREIGN PATENT DOCUMENTS 2-71376 3/1990 Japan .

*Primary Examiner*—Michael L. Gellner
*Assistant Examiner*—P. Stanzione
*Attorney, Agent, or Firm*—Fitzpatrick, Cella, Harper & Scinto

[57] ABSTRACT

A heating apparatus includes a heater which is stationary in use; a film in sliding contact with the heater; a pressing member cooperative with the film to form a nip therebetween; wherein the heater is provided with a portion which is stepped in a direction away from the film toward downstream with respect to a movement direction of the film, the stepped portion being in a width of the nip.

9 Claims, 8 Drawing Sheets

HEATER HAVING STEPPED PORTION AND HEATING APPARATUS USING SAME

FIELD OF THE INVENTION AND RELATED ART

The present invention relates to a heater, having a stepped portion, for heating an image on a recording material and to a heating apparatus using the heater and a sliding film.

In a widely used conventional image fixing apparatus wherein the toner image is fixed on the recording material supporting an unfixed toner image, the recording material is passed through a nip formed between a heating roller maintained at a predetermined temperature and a pressing or back-up roller having an elastic layer and press-contacted to the heating roller. However, the heat roller type fixing apparatus involves a problem that a warming-up period until the predetermined temperature is reached is relatively long.

U.S. Ser. Nos. 206,767 and 444,802 which have been assigned to the assignee of this application have proposed a film fixing apparatus comprising a thermal head, a temperature of which instantaneously rises and a thin film in sliding contact with the thermal head, in which the warming-up period is significantly reduced.

However, in such a film fixing system, there has been found a problem that when the recording material and the fixing film are passed through the stationary heater and the pressing roller, the heated recording material curls down toward the pressing roller. This is because the top side of the recording material is contacted to a flat surface defined by the heater, while the bottom side of the recording material is contacted to the curved surface of the pressing roller, wherein the curvature is relatively large.

Japanese Laid-Open Patent Application No. 2-71376 has proposed to use a heater having a round surface so as to prevent the occurrence of the curling of the recording material. The curl preventing effect increases with decrease of the radius of curvature of the rounded portion. However, the reduction of the radius of curvature results in the reduction of the nip width. This necessitates the increase of the fixing temperature and/or the fixing pressure.

Additionally, in order to make the pressure constant in the direction of the length of the heater, the parallelism must be precise between the peak of the rounded portion of the heater and the pressing roller.

Furthermore, where a base member for supporting a heat generating resistor is made of high thermal conductivity ceramic material such as alumina or the like, it is very difficult to machine the material into the rounded form. This is particularly so in the mass production with high accuracy.

SUMMARY OF THE INVENTION

Accordingly, it is a principal object of the present invention to provide a heater and a heating apparatus wherein the curling of the recording material is effectively prevented.

It is another object of the present invention to provide a heater and a heating apparatus using the same in which the stepped portion is formed by simple processing.

It is a further object of the present invention to provide a heater and a heating apparatus using the same wherein a resistance layer is provided on a base plate having a stepped portion.

It is a yet further object of the present invention to provide a heater and a heating apparatus having a heater and a slidable film, wherein the heater is provided with stepped portions with decreasing steps toward the downstream with respect to a movement direction of the film at the film side and within the nip width.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
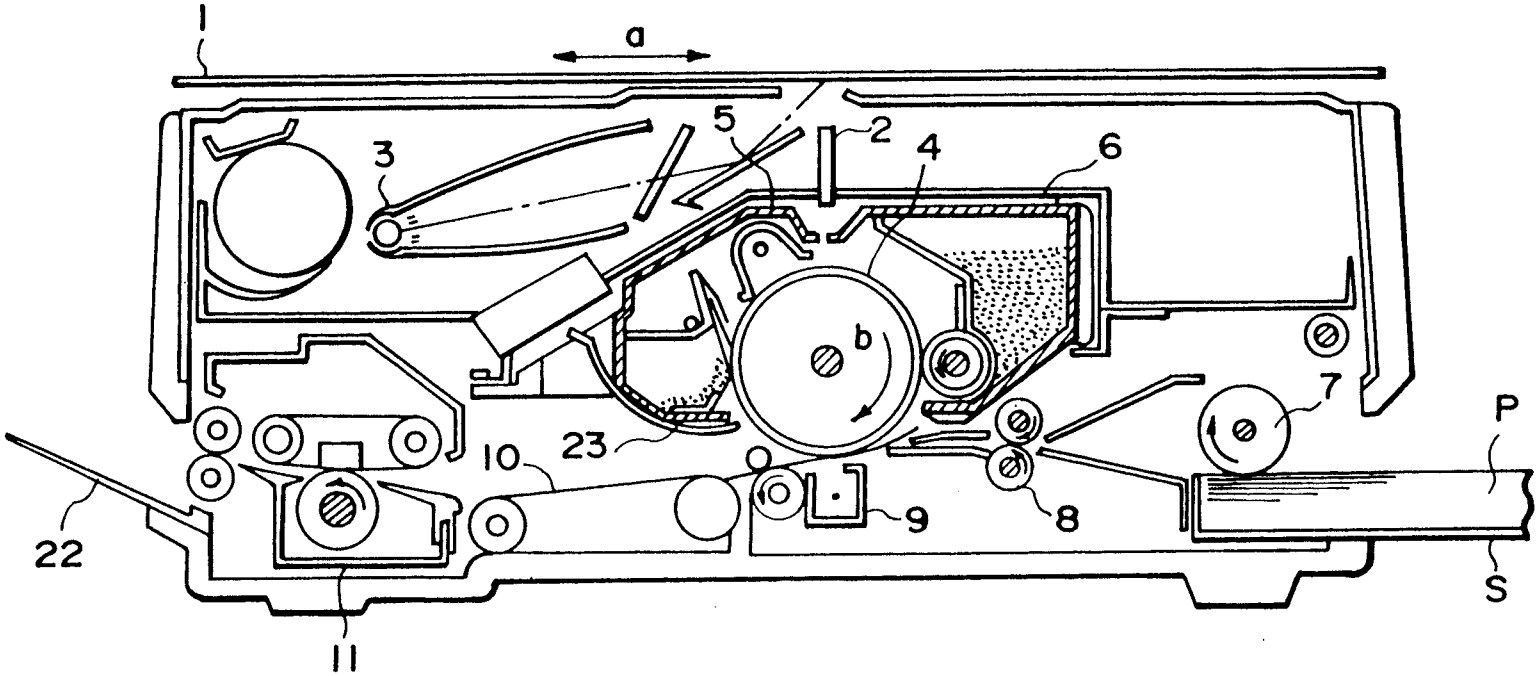
FIG. 1 is a sectional view of an image forming apparatus using an image fixing apparatus according to an embodiment of the present invention.

Referring to FIG. 1, there is shown an image forming apparatus comprising an image fixing apparatus as an exemplary heating apparatus according to an embodiment of the present invention. The image forming apparatus comprises an original supporting platen 1 made of transparent material such as glass, and it is reciprocable in a direction indicated by an arrow a to scan a original to be copied. The image forming apparatus further comprises a short focus small diameter imaging element array 2 right below the original supporting platen 1. An original placed on the platen 1 is illuminated by an illumination lamp 3, and the light image reflected by the original is projected through a solid onto a photosensitive drum 4 by the imaging element array 2. The photosensitive drum 4 rotates in a direction indicated by an arrow b. The image forming apparatus comprises a charger 5 to uniformly charge electrically the photosensitive drum 4. In this embodiment, the photosensitive drum 4 is coated with zinc oxide photosensitive layer or an organic photoconductor photosensitive layer. The photosensitive drum 4 uniformly charged by the charger 5 is exposed to the image light through the array, so that an electrostatic latent image is formed. The electrostatic image is visualized by a developing device 6 using powdery toner made of resin material softened or fused by heat. The recording material P in the form of a recording sheet or the like accommodated in a cassette S is fed to the photosensitive drum 4 by a feeding roller 7 and a conveying rollers 8. The conveying rollers 8 constitute a pair and are presscontacted to each other at the timing for synchronizing the recording material P with the image on the photosensitive drum 4. The toner image is transferred onto the recording material P from the photosensitive drum 4 by a transfer discharger 9. Thereafter, the recording material P is separated from the photosensitive drum 4 by known separating means and is introduced into an image fixing apparatus 11 along a conveyance guide 10. The recording material P is subjected to the heat-fixing operation, and is discharged to a tray 22. After the toner image is transferred, the residual toner on the photosensitive drum 4 is removed by a cleaner 23.

Figure 3:
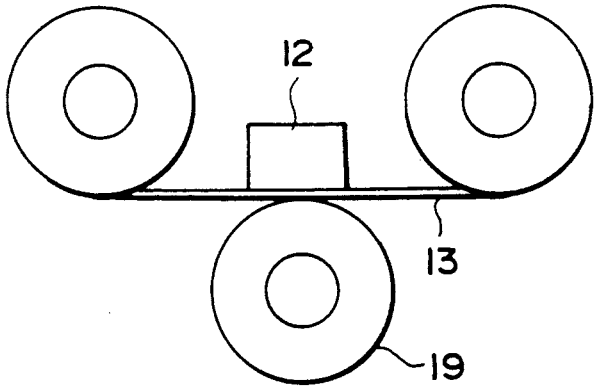
FIG. 3 is a sectional view of an image fixing apparatus according to another embodiment of the present invention.

FIG. 3 is an enlarged sectional view of the image fixing apparatus 11. A low thermal capacity linear heater 12 is fixed on the apparatus and comprises an alumina base plate 13 having a thickness of 1.0 mm, a width of 10 mm and a length of 240 mm and a resistance material 14 having a width of 1.0 mm and applied on the alumina base plate 13. The resistance material 14 is connected with the electric power source at the longitudinally opposite ends. The power supply is in the form of a DC pulse of 100 V and 200 msec frequency. The pulse width is changed within approximately 0.5–5 msec in accordance with the desired temperature, the energy emission and the temperature detected by a temperature sensor 15.

In contact with the heater 12 having a controlled temperature, the fixing film 16 moves in the direction indicated by an arrow. An example of the fixing film 16 comprises a heat-resistive film having a thickness of 20 microns made of polyimide, polyetherimide, PES, PFA or the like, and a parting layer coated at least on the image contactable side of the heat resistive film. The parting layer is of fluorine resin such as PTFE or PFA, added with electrically conductive material. The fixing film 16 is in the form of an endless belt. The total thickness of the film is generally less than 100 microns, preferably less than 70 microns. The fixing film 16 is driven by a driving roller 17 and a follower and tension roller 18 in the direction of the arrow without crease.

A back-up or pressing roller 19 comprises a rubber elastic layer having a parting property, such as silicone rubber or the like. It is pressed to the heater 12 with the fixing film 16 therebetween at a total pressure of 4–15 kg, so that it rotates relatively on the fixing film 16.

The recording material P having the unfixed toner image 20 is introduced into the fixing station by an inlet guide 21, so that the fixed image is provided by the heating.

Figure 2:
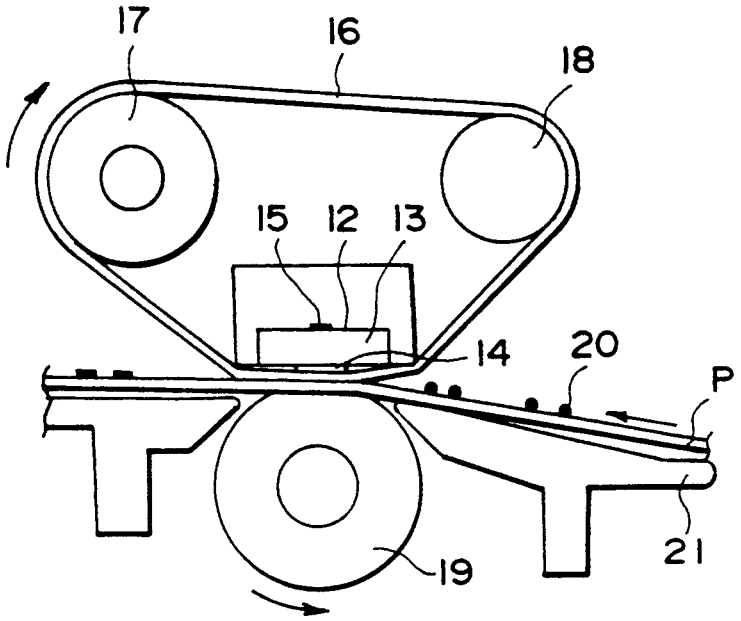
FIG. 2 is a sectional view of the image forming apparatus according to the embodiment of the present invention.

In the example of FIG. 2, the fixing film 16 is in the form of an endless belt, but as shown in FIG. 3, the fixing film 16 may be in the form of a non-endless belt.

Figure 4:
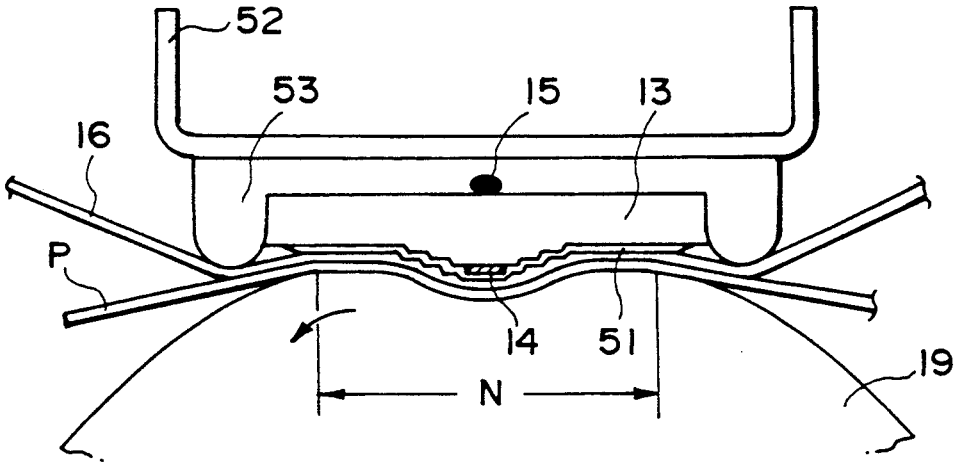
FIG. 4 is an enlarged sectional view of a nip in the embodiment of the present invention.

FIG. 4 is an enlarged sectional view of a heating nip of the fixing apparatus 11 of FIG. 2. As described in the foregoing, the alumina base plate 13 is coated with a resistance material 14 which is a heat generating material. The resistance material 14 is coated with a protection layer 15 of glass.

The alumina base plate 13, the resistance material 14 and a protection layer 51 constitute an integral unit, which is mounted to an insulating member 53 by a heat resistive both sided tape or heat resistive bonding agent. The heat insulative member 53 is mounted on a stay 52 for supporting the heater. The stay 52 is of such a material and a structure that even when it is pressed by the pressing roller 19, it is not largely deformed at the central portion.

In this embodiment, the alumina base plate 13 is provided with stepped portions by machining it, and the resistance material 14 is mounted on the top step. The heights of the steps from the base portion of the alumina base plate 13 decreases within the width N of the nip toward downstream of the resistance material 14. The stepped portions act on the recording material P to correct the curling due to the pressing roller 19.

In this embodiment, the alumina base plate is machined to provide three steps with the step height of 30 microns so that the total height of the steps is 90 microns. As the heat generating resistance material, a paste comprising Ag/Pd (silver palladium) and glass is printed and sintered. The sintered material is coated with glass paste as a protection layer and is sintered. By properly determined the step configuration and the step positions of the heater, the recording material is hardly curled. In addition, the direction of the curling can be controlled by properly determining the conditions under which the sheet is discharged.

Referring to FIGS. 5–11, other embodiments will be described wherein the alumina base is machined and abraded to provide the steps.

Figure 5:
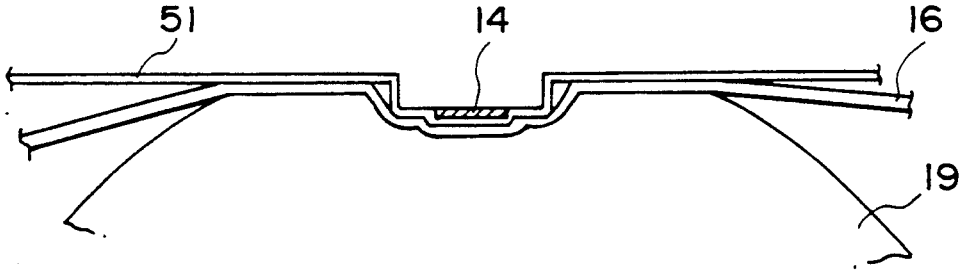
FIG. 5 is an enlarged sectional view of a nip of the fixing apparatus according to a further embodiment of the present invention.
Figure 6:
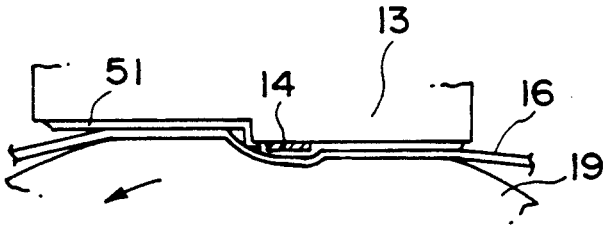
FIG. 6 is an enlarged sectional view of a nip of an image fixing apparatus according to a further embodiment of the present invention.

FIG. 5 embodiment comprises one step. In FIG. 6 embodiment, the downstream side of the heater is abraded by 40 microns to provide the step. The curl preventing effect is strong if the step is provided at the downstream side adjacent the heat generating element.

Figure 7:
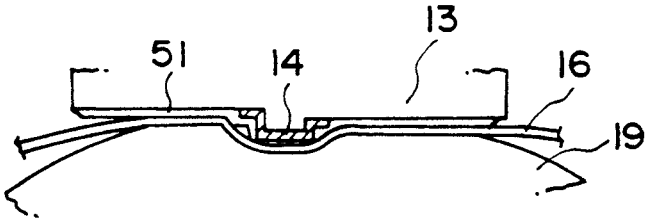
FIG. 7 is an enlarged sectional view of a nip of an image fixing apparatus according to a further embodiment of the present invention.

In FIG. 7, the stepped portions are provided both at the upstream and downstream sides of the heater nip, wherein the step height is 50 microns at the upstream side and 100 microns at the downstream side. In this embodiment, the heat generating resistor layer extends over the steps, and therefore, the printing of the heat generating resistor layer is difficult if the step is 200 microns or larger. However, the curl preventing effect is stronger than in FIG. 6 embodiment, and the recording material is slightly curled upwardly.

Figure 8:
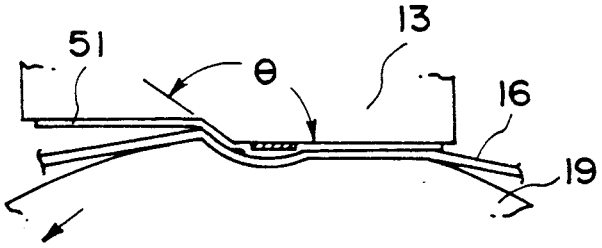
FIG. 8 is an enlarged sectional view of a nip of an image fixing apparatus according to a further embodiment of the present invention.

In FIG. 8 embodiment, there is an inclined or tapered portion between steps, and the angle Θ of the portion is not less than 90 degrees and not more than 170 degrees, preferably not less than 90 degrees and not more than 150 degrees.

Figure 9:
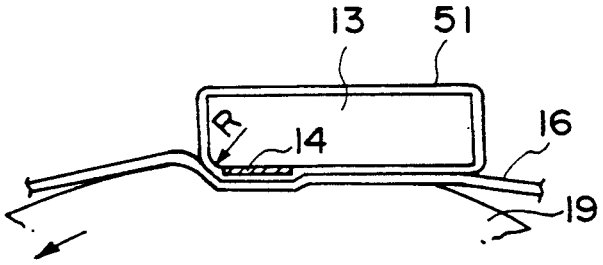
FIG. 9 is an enlarged sectional view of a nip of an image fixing apparatus according to a further embodiment of the present invention.

In FIG. 9, the step is provided utilizing edges of the heat generating element. In this embodiment, the inside surface of the film may be scraped by the edge of the heater. In view of this, a glass layer is provided by a dipping method so as to provide a round portion at the corner. The curl preventing effect is dependent on the position of the edge relative to the nip and the degree of the rounding (curvature). The radius R of the curvature is preferably not less than 10 microns and not more than 10 mm.

Figure 10:
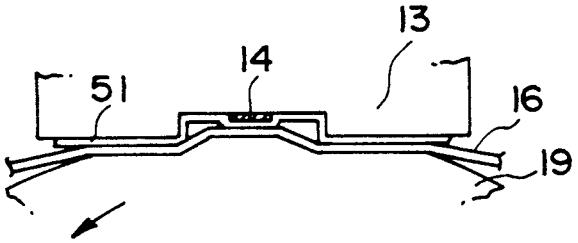
FIG. 10 is an enlarged sectional view of a nip of an image fixing apparatus according to a further embodiment of the present invention.

In FIG. 10 embodiment, the steps constitute a groove. The curl preventing or correcting effect is possible either with a projection or recess in the direction of the recording material movement. However, the recess type step is generally more effective to correct the curling.

Figure 11:
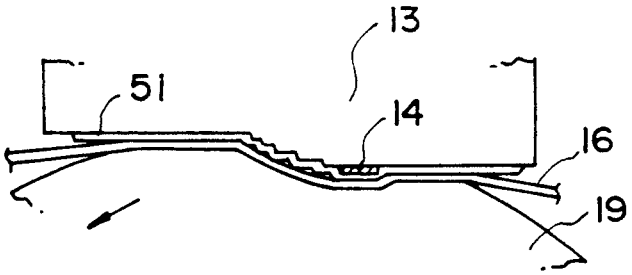
FIG. 11 is an enlarged sectional view of a nip of an image fixing apparatus according to a further embodiment of the present invention.

In FIG. 11 embodiment, five steps each having 8 microns height are provided, in which the total height is 40 microns. The step height is preferably not less than 10 microns, further preferably not more than 40 microns from the standpoint of curl correcting or preventing effect.

In FIGS. 4–11 embodiments, the steps are provided by machining the alumina base plate. Further embodiment will be described.

Figure 12:
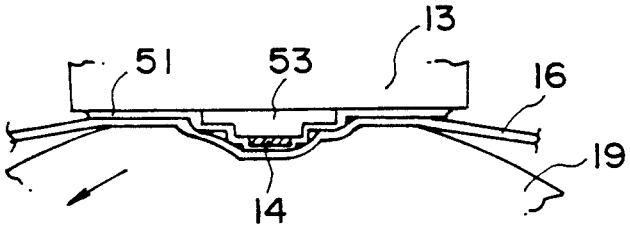
FIG. 12 is an enlarged sectional view of a nip of an image fixing apparatus according to a further embodiment of the present invention.
Figure 13:
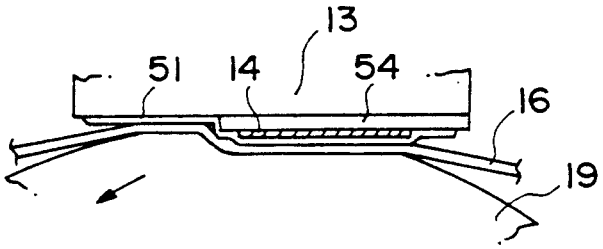
FIG. 13 is an enlarged sectional view of a nip of an image fixing apparatus according to a further embodiment of the present invention.

In FIG. 12 embodiment, one step is provided by printing five glass layers each having a thickness of 10 microns to provide 50 micron step height. Glass layers having different areas are provided on the alumina base plate so as to provide two steps at each of the inlet and outlet portions. In FIG. 13, an alumina plate having a thickness of 100 microns is bonded on a base alumina plate having a thickness of 1 mm, and a heat generating resistor layer and a protection layer are provided thereon, so that the stepped portions are formed.

Figure 14:
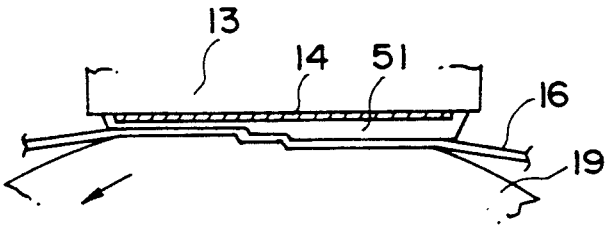
FIG. 14 is an enlarged sectional view of a nip of an image fixing apparatus according to a further embodiment of the present invention.

In FIG. 14, the steps are provided in another method. The protection layers are repeatedly printed so that two steps each having 20 micron height are provided at the film outlet side, while the protection layers are aligned at the inlet side.

Figure 15:
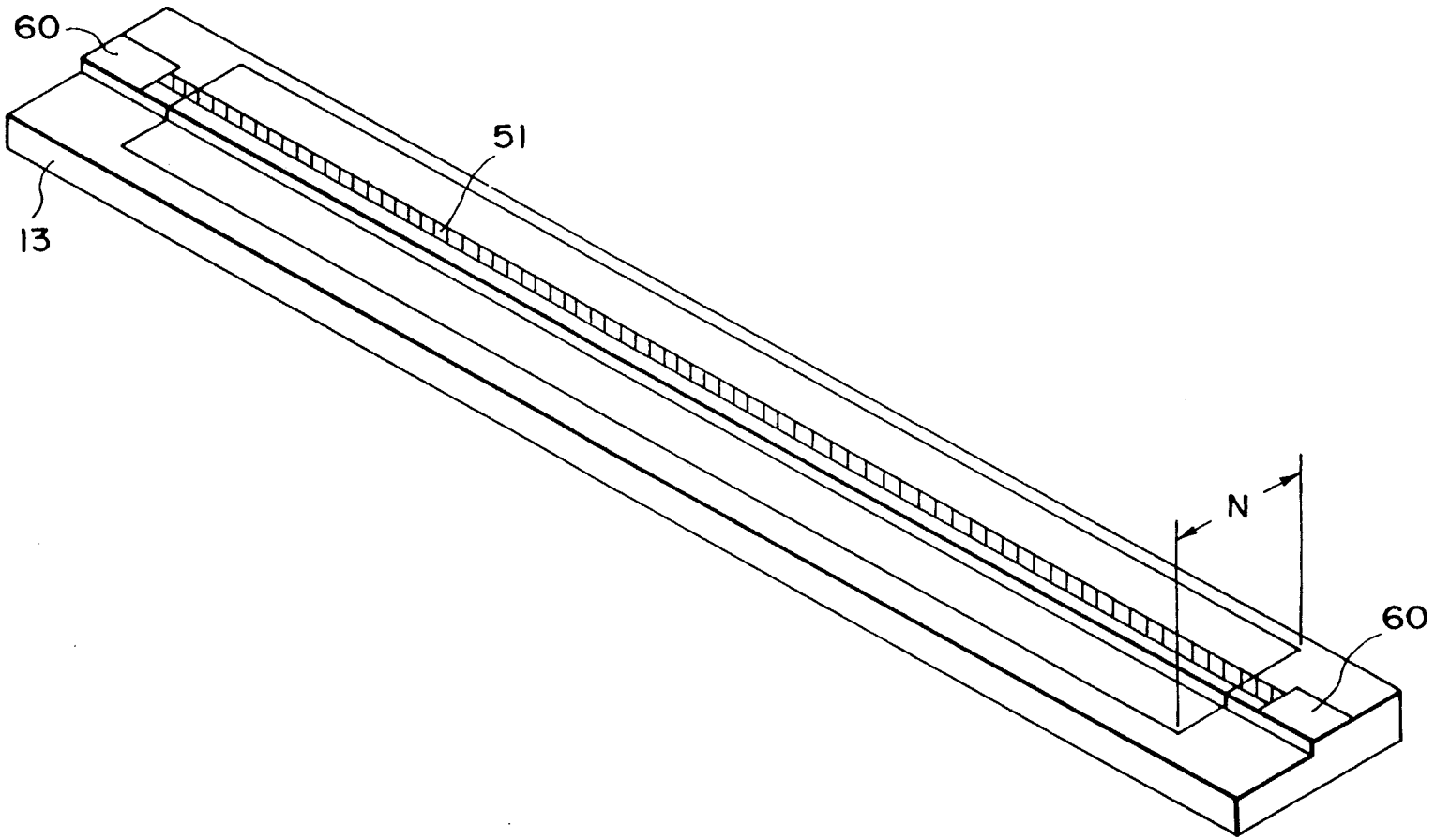
FIG. 15 is a perspective view of a heater used in the embodiment of the present invention.

FIG. 15 is a perspective view of a heater used in the device of FIG. 6 embodiment. The step is provided so that it is within the nip width N over the entire length of the nip. Designated by a reference numeral 60 is electrodes for the power supply to the heater.

Figure 16:
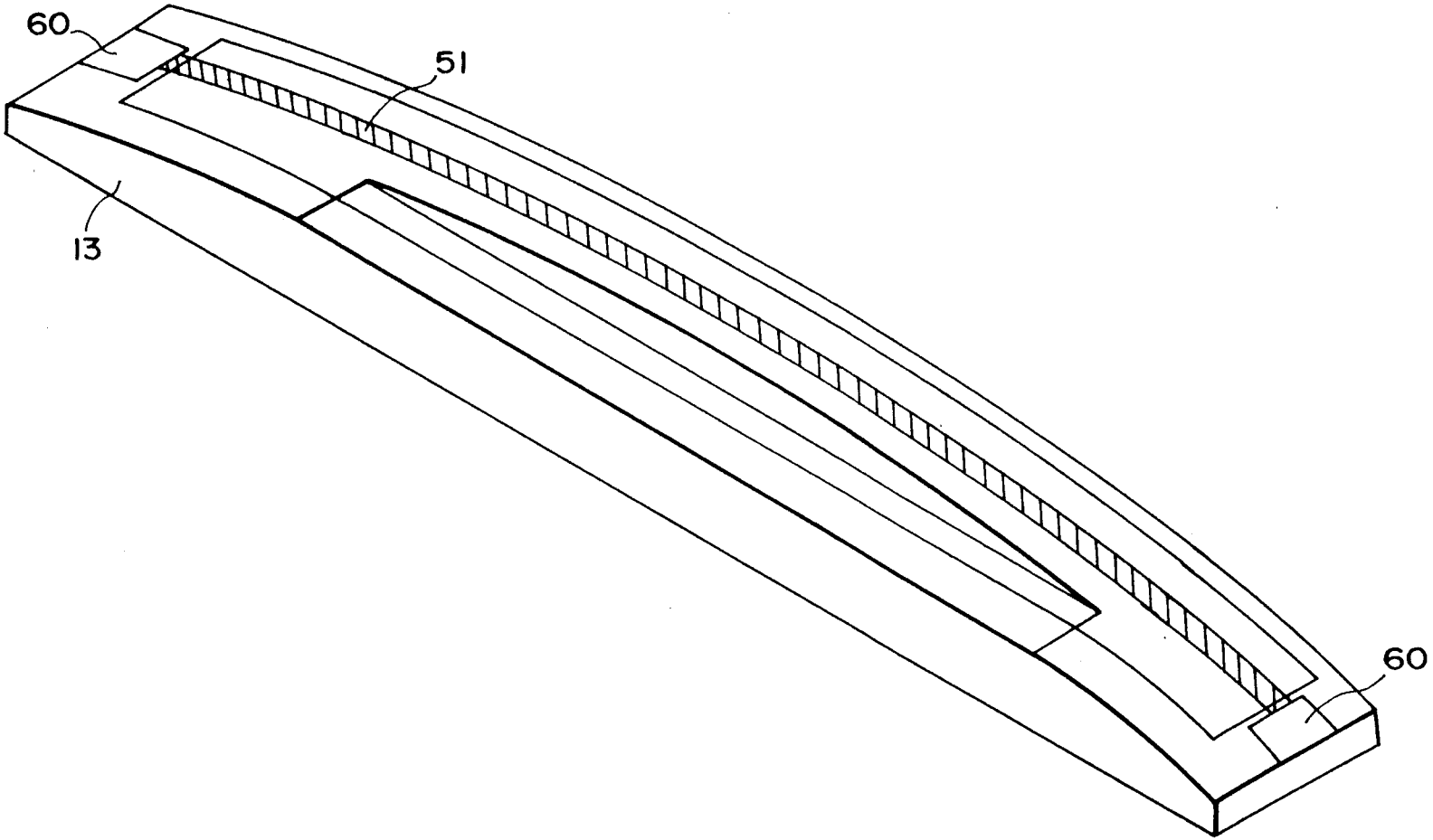
FIG. 16 is a perspective view of a heater according to another embodiment of the present invention.

In FIG. 16, the heater is crowned in the direction of the length thereof, that is, in the direction perpendicular to the movement direction of the film, so that it is bulged at the longitudinally central portion thereof. In this embodiment, the step is formed only at the central portion rather than over the entire length of the nip.

Figure 17:
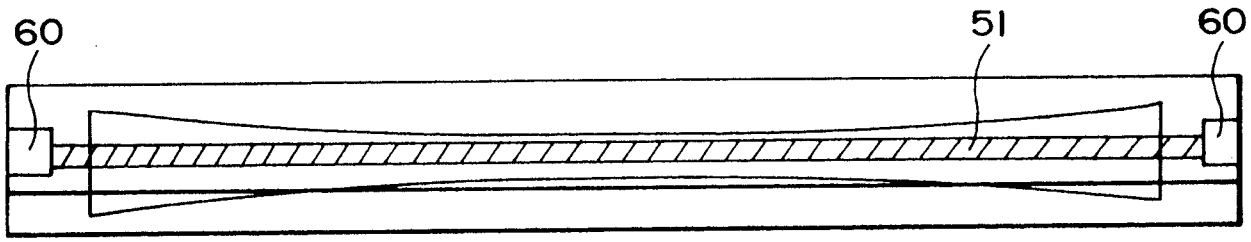
FIG. 17 is a top plan view of an image fixing apparatus according to a yet further object of the present invention.

In FIG. 17, the step is formed over the entire length of the nip, and the pressing roll is crowned reversely so as to provide an hourglass-shaped nip, and the step is formed in the nip only adjacent the longitudinally opposite ends. In this case, the step may be arcuated following the curve of the nip region.

According to the embodiments of the present invention, the curl can be prevented because the recording material is rubbed or scraped by the step having a step height not less than 10 microns, and therefore, the curling of the recording material can be effectively prevented. In addition, the curl preventing effect can be provided by the small step height, and therefore, the nip width hardly changes, as contrasted to the case of using the rounded portion. In addition, the processing or machining is easy to permit mass production.

The material of the base plate is not limited to the alumina, but another material is usable if it exhibits high heat durability and relatively low thermal capacity. The material of the heat generating resistor may be ruthenium oxide or the like. The materials of the protection layer include heat resistive inorganic material such as glass or ceramic and heat resistive organic material such as polytetrafluoroethylene (PTFE) resin or polyimide (PI) resin material.

According to the present invention, the curling of the recording material can be corrected with easy machining or processing or method, without substantial reduction of the nip width.

While the invention has been described with reference to the structures disclosed herein, it is not confined to the details set forth and this application is intended to cover such modifications or changes as may come within the purposes of the improvements or the scope of the following claims.

What is claimed is:

1. A heating apparatus, comprising:

a heater which is stationary in use;

a film in sliding contact with said heater;

a pressing member cooperative with said film to form a nip therebetween;

wherein said heater is provided with a portion which is stepped in a direction away from said film toward downstream with respect to a movement direction of said film, said stepped portion being in a width of the nip.

2. An apparatus according to claim 1, wherein a step of said stepped portion has a step height of not less than 10 microns.

3. An apparatus according to claim 1, wherein said heater is provided with a heat generating resistor layer extending in a direction crossing with a movement direction of said film, said heat resistance layer generating heat upon electric power supply thereto, and wherein said stepped portion is provided at each of upstream and downstream sides of said resistance layer in a movement direction of said film.

4. An apparatus according to claim 1, wherein a plurality of such stepped portions are provided.

5. An apparatus according to claim 1, wherein said heater is provided with a resistance layer generating heat upon electric power supply thereto, and a base plate for supporting said resistor layer, wherein said stepped portion is provided by machining said base plate.

6. An apparatus according to claim 5, wherein said base plate is of ceramic material.

7. An apparatus according to claim 6, wherein the ceramic material is of alumina.

8. An apparatus according to claim 1, wherein said pressing member is in the form of a rotatable member having a rubber layer.

9. An apparatus according to claim 1, wherein said nip receives a recording material carrying an unfixed image to fix it.

* * * * *

UNITED STATES PATENT AND TRADEMARK OFFICE

CERTIFICATE OF CORRECTION

PATENT NO. : 5,267,005

DATED : November 30, 1993

INVENTOR(S) : AKIRA YAMAMOTO, ET AL.

It is certified that error appears in the above-identified patent and that said Letters Patent is hereby corrected as shown below:

COLUMN 3

Line 32, "a" should be deleted;
Line 33, "presscontacted" should read --press-contacted--.

COLUMN 4

Line 23, "layer 15" should read --layer 51--.

COLUMN 5

Line 51, "60 is" should read --60 are--.

Signed and Sealed this

Sixteenth Day of August, 1994

*Attest:*

*Attesting Officer*

BRUCE LEHMAN

*Commissioner of Patents and Trademarks*